United States Patent [19]

Bertrand et al.

[11] Patent Number: 5,075,185

[45] Date of Patent: Dec. 24, 1991

[54] IMAGING PROCESS COMPRISING TRI-LEVEL IMAGING AREA AND AN ALUMINUM COMPLEX CHARGE ENHANCING ADDITIVE

[75] Inventors: Jacques C. Bertrand, Ontario; Denise R. Leon-Bayley, Fairport; Roger N. Ciccarelli, Rochester; Linda J. Nelson, Webster, all of N.Y.

[73] Assignee: Xerox Corporation, Stamford, Conn.

[21] Appl. No.: 500,335

[22] Filed: Mar. 28, 1990

[51] Int. Cl.[5] ..... G03G 13/01; G03G 13/09

[52] U.S. Cl. ..... 430/45; 430/122

[58] Field of Search ..... 430/45, 122

[56] References Cited

U.S. PATENT DOCUMENTS

| | | | |
|---|---|---|---|
| 4,078,929 | 3/1978 | Gundlach | 96/1.2 |
| 4,686,163 | 8/1987 | Ng et al. | 430/47 |
| 4,758,491 | 7/1988 | Alexandrovich et al. | 430/110 |
| 4,845,003 | 7/1989 | Kiriu et al. | 430/110 |
| 4,845,004 | 7/1989 | Kobayashi | 430/110 |
| 4,855,208 | 8/1989 | Tada et al. | 430/110 |
| 4,948,686 | 8/1990 | Koch et al. | 430/45 |

*Primary Examiner*—David Welsh
*Assistant Examiner*—S. Rosasco
*Attorney, Agent, or Firm*—E. O. Palazzo

[57] ABSTRACT

An imaging process which comprises (1) charging an imaging member in an imaging apparatus (2) creating on the member a latent image comprising areas of high, intermediate, and low potential; (3) developing the low areas of potential with a first developer comprising carrier and a first toner comprised of resin, pigment excluding black and an aluminum complex charge enhancing additive; (4) developing the high areas of potential with a second developer comprising carrier and a second toner comprised of resin, pigment, and a charge enhancing additive that enables a positively charged toner; (5) transferring the resulting developed image to a substrate; and (6) fixing the image thereto.

74 Claims, No Drawings

IMAGING PROCESS COMPRISING TRI-LEVEL IMAGING AREA AND AN ALUMINUM COMPLEX CHARGE ENHANCING ADDITIVE

BACKGROUND OF THE INVENTION

The present invention is directed to imaging processes, a process for forming two-color images, and more specifically, the present invention is directed to a process for obtaining two-color images which in an embodiment comprises charging an imaging member, creating on the member a latent image comprising areas of high, medium, and low potential, developing the low areas of potential with a developer composition, subsequently developing the high areas of potential with a developer composition, transferring the developed image to a substrate, and optionally permanently affixing the image to the substrate. Another embodiment of the present invention relates to processes for obtaining two-color images which comprises charging an imaging member, creating on the member a latent image comprising areas of high, medium, and low potential, developing the low areas of potential with a developer composition comprised of toner with an aluminum complex charge enhancing additive, subsequently developing the high areas of potential with a developer composition comprised of a colored toner, especially a blue toner containing a charge enhancing additive, transferring the developed images to a substrate, and permanently affixing the images to the substrate by, for example, heat or a combination of heat and pressure. One advantage associated with the processes of the present invention is the ability to generate high quality two-color images in a single development pass, particularly as a result of the absence of interaction between the colored, excluding black, and the black developers in an embodiment of the present invention. Other advantages associated with the present invention include the provision of a developer with stable negative triboelectical toner characteristics and stable negative triboelectrically charged toner which enables the generation of high quality images subsequent to development, that is images with substantially no background deposits and substantially no smearing for a broad range of relative humidity conditions, that is for example from 20 to 90 percent relative humidity at an effective range of temperature zones ranging, for example, from about 20° C. to about 80° C.

Processes for obtaining electrophotographic, including xerographic, and two-colored images are known. In U.S. Pat. No. 4,264,185, the disclosure of which is totally incorporated herein by reference, there is illustrated an apparatus for forming two color images by forming a bipolar electrostatic image of a two-color original document on a photoconductive drum. A first developing unit applies a toner of a first color and polarity to the drum and a second developing unit applies a toner of a second color and polarity to the drum to form a two color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821 there is disclosed a method and apparatus for forming two-color images which employs two magnetic brushes. The first developed image is not disturbed during development of the second image since the second magnetic brush contacts the surface of the imaging member more lightly than the first magnetic brush, and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second nonmagnetic sleeve and the surface of the imaging member. In addition, the toners selected may have different quantities of electric charge.

Further, U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography which comprises two kinds of developers, each of which consists of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Additionally, U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

In addition, U.S. Pat. No. 4,500,616 discloses a method of developing electrostatic latent images by selectively extracting colored grains of one polarity from a mixture containing colored grains having opposite polarity to each other in the presence of an alternating field, followed by development of the electrostatic image by the selectively extracted colored grains. Further, U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image to develop the noncharged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

Furthermore, in U.S. Pat. No. 4,525,447, the disclosure of which is totally incorporated herein by reference, there is illustrated an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier. Also, U.S. Pat. No. 4,539,281 discloses a method of forming dichromatic copy images by forming an electrostatic latent image having a first image portion and a second image portion. The first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a nonmagnetic toner of a second color chargeable to a polarity opposite to that of the magnetic toner by contact with the magnetic carrier.

Additionally, U.S. Pat. No. 4,562,129, the disclosure of which is totally incorporated herein by reference, illustrates a method of forming dichromatic copy images with a developer composed of a high-resistivity magnetic carrier and a nonmagnetic insulating toner, which are triboelectrically chargeable. An electrostatic latent image having at least three different levels of potential is formed and the toner and carrier are adhered, respectively, onto the first and second image portions. In addition, U.S. Pat. No. 4,640,883, the disclosure of which is totally incorporated herein by reference, illustrates a method of forming composite or dichromatic images which comprises forming on an imaging member electrostatic latent images having at least three different potential levels, the first and second latent images being represented, respectively, by a first potential and a second potential relative to a common background potential. The first and second images are developed by a first magnetic brush using two kinds of toners, at least one of which is magnetic, and both of which are chargeable to polarities opposite to each other with application to a developing electrode of a bias voltage capable of depositing the magnetic toner on the background potential area to deposit selectively the two toners on the first and second latent images and to deposit the magnetic toner on the background potential area, while collecting the deposited toner at least from the background potential area by second magnetic brush developing means.

In a patentability search report, the following prior art United States patents were listed: U.S. Pat. No. 4,845,004 directed to hydrophobic silicon type micropowders comprising silicon type microparticles which have been treated with secondary tertiary amine functional silanes, and when the micropowders combine with the positively charging resin powder, such as a toner, the fluidity of the resin powder is substantially increased, see for example the Abstract of the Disclosure, column 1, beginning at line 60, and continuing on to column 4 and the working Examples; U.S. Pat. No. 4,758,491 directed to dry toner and developer compositions with good charge stability and minimization of toner image transfer defects, which composition comprises a major component of a normally solid fixable binder resin which is free of siloxane segments and is a minor component in a normally solid multiphase thermoplastic condensate polymer which contains a polyorgano siloxane block or graft segment, note specifically the use of a charge control agent in column 2, beginning at line 50, examples of charge control agents being detailed, for example, in column 4, beginning at line 23, including ammonium or phosphonium salts, and the like; U.S. Pat. No. 4,845,003 directed to a toner for developing electrostatic latent images characterized in that the toner comprises an aluminum compound of a hydroxy carboxylic acid which may be substituted with alkyl and/or arylalkyl, see for example column 2, beginning at line 29, and continuing on to column 5, it being noted that the aluminum complex compounds of this patent may be selected as the charge enhancing additive component for one of the developer compositions of the present invention comprised of resin pigment excluding black, the disclosure of this patent being totally incorporated herein by reference; and U.S. Pat. No. 4,855,208 directed to a toner for developing electrostatic latent images, which toner comprises an aluminum compound of an aromatic amino carboxylic acid as represented by the formula illustrated in the Abstract of the Disclosure, and also see column 2, beginning at line 26, and continuing on to column 7. The aluminum compound of the '208 patent may be selected in an embodiment as a charge enhancing additive for the colored toner and developer, that is developer without black pigment, of the present invention.

Other representative patents of interest with respect to formation of two-color images include U.S. Pat. Nos. 4,045,218 and 4,572,651.

The process of charging a photoresponsive imaging member to a single polarity and creating on it an image consisting of at least three different levels of potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the tri-level process for generating images is U.S. Pat. No. 4,686,163, the disclosure of which is totally incorporated herein by reference.

Illustrated in copending application U.S. Ser. No. 342,132, the disclosure of which is totally incorporated herein by reference, is a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the process of the copending application may be of any type capable of maintaining three distinct levels of potential. Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range, with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected.

Although the known processes for forming two-color images are suitable for their intended purposes, a need continues to exist for processes for forming two-color images. In addition, a need remains for two-color image formation processes wherein the two developers exhibit a low level of mutual interaction. Mutual interaction may occur, for example, when the carrier of the developer used triboelectrically charges against the toner used first; thus, the first image is developed with the first developer and the second image is subsequently developed with the second developer of different color, and during development of the second image, the carrier of the second developer triboelectrically interacts with the image previously developed with the first toner. This interaction can result in removal of some of the first toner from the substrate, causing reduced image density, and can also cause contamination of the second developer housing with the first toner. A need also exists for a process for forming two-color images wherein the second developer does not react with, or is triboactively neutral to, the first developed image on the photoreceptor. A need also exists for a process for forming two-color images wherein the first developer does not discharge the latent image to be developed by the second developer. Additionally, there is a need for a two-color image formation process wherein the developers are of specified triboelectric charge, charge distribution, and conductivity, and exhibit acceptable admix times and developer lifetimes. Further, there is a need for a two-color image formation process wherein the two developers exhibit similar rheological properties, thereby enhancing fusing, and similar cleaning latitudes, thereby enhancing cleaning of the photoreceptor. Also, there is a need for toners and imaging processes thereof wherein there is selected a black toner with an alkyl pyridinium halide charge enhancing additive and a colored, especially blue, toner with an aluminum complex charge enhancing additive. Examples of aluminum complex charge enhancing additives and electrostatic processes thereof are described in U.S. Pat. No. 4,845,003, the disclosure of which is totally incorporated herein by reference.

There is also a need for imaging processes wherein there are selected two toners, one of which is a color toner, that is a toner containing pigments other than black such as cyan, magenta, yellow, red, blue, green, and mixtures thereof and a charge enhancing additive, preferably an aluminum complex charge enhancing additive as illustrated herein.

SUMMARY OF THE INVENTION

It is an object of the present invention to provide imaging processes.

It is another object of the present invention to provide imaging processes for forming two-color images.

It is another object of the present invention to provide two-color image formation processes wherein the two developers selected exhibit a low level of mutual interaction.

It is still another object of the present invention to provide toners and processes for forming two-color images wherein the second developer does not react with, or is triboactively neutral to, the first developed image on the photoreceptor.

It is yet another object of the present invention to provide a process for forming two-color images wherein the first developer does not discharge the latent image to be developed by the second developer.

Another object of the present invention is to provide a two-color image formation process wherein the developers are of specified triboelectric charge, charge distribution, and conductivity, and exhibit acceptable admix times and developer lifetimes.

Still another object of the present invention is to provide a two-color image formation process wherein the two developers exhibit similar rheological properties, thereby enhancing fusing and similar cleaning latitudes, thereby enhancing cleaning of the photoreceptor.

Moreover, in another object of the present invention there are provided two-color image formation processes wherein a black toner with an alkyl pyridinium halide or other similar charge additive, and a colored, especially blue, toner with an aluminum complex charge additive are selected.

These and other objects of the present invention are accomplished by providing developers, toners and imaging processes thereof. In an embodiment of the present invention there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto.

In an embodiment of the present invention, the first developer comprises, for example, a first toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, Pliolites, crosslinked styrene acrylates, crosslinked styrene methacrylates, and the like wherein the crosslinking component is, for example, divinyl benzene, and mixtures thereof; a first colored blue, especially PV Fast Blue pigment present in an effective amount of from, for example, about 1 to about 15 percent by weight, and preferably from about 1 to about 3 weight percent; an aluminum complex charge enhancing additive; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, Pliolites, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in a preferred embodiment the black toner is comprised of 92 percent by weight of a styrene n-butyl methyacrylate copolymer (58/42), 6 percent by weight of Regal 330® carbon black, and 2 percent by weight of the charge enhancing additive cetyl pyridinium chloride. The aforementioned toners may include as surface or external components additives in an effective amount of, for example, from about 0.1 to about 3 weight percent, such as colloidal silicas, metal salts, metal salts of fatty acids, reference for example U.S. Pat. Nos. 3,590,000; 3,655,374; 3,900,588 and 3,983,045, the disclosures of which are totally incorporated herein by reference, metal oxides and the like for the primary purpose of controlling toner conductivity and powder flowability.

The carrier for the colored developer in an embodiment of the present invention can be comprised of a steel core with an average diameter of from about 25 to about 225 microns and a coating thereover selected from the group consisting of methyl terpolymer, polymethyl methacrylate, and a blend of from about 35 to about 65 percent by weight of polymethylemethacrylate and from about 35 to about 65 percent by weight of chlorotrifluoroethylene-vinyl chloride copolymer wherein the coating contains from 0 to about 40 percent by weight of the coating conductive particles, such as carbon black, and wherein the coating weight is from about 0.2 to about 3 percent by weight of the carrier. The carrier for the second developer can be comprised of a steel core with an average diameter of from about 25 to about 225 microns and a coating thereover selected from the group consisting of chlorotrifluoroethylene-vinyl chloride copolymer containing from 0 to about 40 percent by weight of conductive particles and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. Other effective carriers may be selected some of which are specifically illustrated hereinafter.

Examples of imaging members selected for the processes of the present invention may be of any type capable of maintaining three distinct levels of potential. Generally, various dielectric or photoconductive insulating material suitable for use in xerographic, ionographic, or other electrophotographic processes may be used, such as amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can consist of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

The latent image comprising three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a trilevel charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power. Other electrophotographic and ionographic methods of generating latent images are also acceptable.

Generally, in the process of the present invention the highlighted areas of the image are developed with a developer having a color other than black, while the remaining portions of the image are developed with a black developer. In general, the highlighted color portions are developed first to minimize the interaction between the two developers, thereby maintaining the high quality of the black image.

Development is generally accomplished by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is presented on the photoreceptor under these development potentials to result in acceptable image density. Conductive development is also preferred to ensure that fringe fields occurring around the edges of images of one color are not developed by the toner of the other color.

During the development process, the developer housings are biased to a voltage between the level of potential being developed and the intermediate level of charge on the imaging member. For example, if the latent image comprises a high level of potential of about −800 volts, an intermediate level of potential of about −400 volts, and a low level of about −100 volts, the developer housing containing the positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

Developer compositions suitable for the process of the present invention comprise a toner and a carrier. Preferred carriers are generally conductive, and exhibit in an embodiment of the present invention a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating by partially coating the carrier core, or by coating the core with a coating containing carbon black the carrier is rendered conductive. In addition, irregularly shaped carrier particle surfaces and toner concentrations of from about 0.2 to about 5 will generally render a developer conductive. Addition of a surface additive such as zinc stearate to the surface of the toner particles also renders a developer conductive with the level of conductivity rising with increased concentrations of the additive. Other carriers, including those with conductivities not specifically mentioned, may also be selected, including the carriers as illustrated in U.S. Pat. No. 4,883,736, the disclosure of which is totally incorporated herein by reference, and copending applications U.S. Ser. Nos. 136,791 and 136,792, the disclosures of which are totally incorporated herein by reference. The aforementioned carriers in one embodiment comprise a core with two polymer coatings not in close proximity in the triboelectric series.

More specifically, the carrier for the developers of the present invention generally comprises ferrite, iron or a steel core, preferably unoxidized, such as Hoeganoes Anchor Steel Grit, with an average diameter of from about 25 to about 215 microns, and preferably from about 50 to about 150 microns. These carrier cores are coated with a solution coating of methyl terpolymer, reference for example U.S. Pat. Nos. 3,467,634 and 3,526,533, the disclosure of which is totally incorporated herein by reference, containing from 0 to about 40 percent by weight of conductive particles such as carbon black or other conductive particles as disclosed in U.S. Pat. No. 3,533,835, the disclosure of which is totally incorporated herein by reference, homogeneously dispersed in the coating material with the coating weight being from about 0.2 to about 3 percent by weight of the carrier, and preferably from about 0.4 to about 1.5 percent by weight of the carrier. Also, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier and preferably about 1 percent by weight of the carrier. Another carrier coating for the carrier of the colored developer comprises a blend of from about 35 to about 65 percent by weight of polymethylmethacrylate and from about 35 to about 65 percent by weight of chlorotrifluoroethylenevinyl chloride copolymer, commercially available as OXY 461 from Occidental Petroleum Company and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier. Preferably, the carrier coatings are placed on the carrier cores by a solution coating process.

Colored toners suitable for development of the highlighted portions of the image generally comprise a resin or resins, one or a blend of two or more pigments, dyes, mixtures thereof, and an aluminum complex charge enhancing additive such as those illustrated in U.S. Pat. No. 4,845,033, the disclosure of which is totally incorporated herein by reference, and more specifically Bontron E-88 available from Orient Chemical Company. More specifically, there is illustrated in the aforementioned U.S. Pat. No. 4,845,033 patent as charge enhancing additives aluminum compounds of an aromatic hydroxycarboxylic acid, which is unsubstituted or substituted with alkyl and/or aralkyl, and can be prepared from an aromatic hydroxycarboxylic acid, which is unsubstituted or substituted with alkyl and/or aralkyl, by treating the acid with an aluminum component. The aluminum complex in an embodiment of the U.S. Pat. No. 4,845,003 patent is represented by the formula as illustrated in column III, which formula is as follows:

$$[Al(Y)_a]^{b-} \cdot X^{+b}$$

wherein Y can be a difunctional or divalent radical, X is a corresponding counter ion such as hydrogen, $NH_4$, an ammonium ion of a primary, secondary or tertiary amine, or quaternary ammonium ion, a is 2 or 3, and b is 1 when a is 2 and b is 3 when a is 3. Typical toner resins include styrene acrylates, styrene methacrylates, polyesters, Pliolites®, Pliotines® available from Goodyear Chemical Company, styrene-butadiene polymers, particularly styrene-butadiene copolymers wherein the styrene portion is present in an amount of from about 83 to about 93 percent by weight, and preferably about 88 percent by weight, and the butadiene portion is present in an amount of from about 7 to about 17 percent by weight, and preferably about 12 percent by weight, such as resins commercially available as Pliolite® or Pliotone® from Goodyear. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable.

Furthermore, particularly suitable are styrene-n-butylmethacrylate polymers wherein the styrene portion is present in an amount of from about 50 to about 80 percent by weight, and preferably about 65 percent by weight, and the n-butylmethacrylate portion is present in an amount of from about 50 to about 20 percent by weight, and preferably about 35 percent by weight. The resin is generally present in an amount of from about 80 to about 98.8 percent by weight.

Suitable colored, excludes black, toner pigments include Sudan Blue OS, commercially available from BASF, Neopan Blue, commercially available from BASF, and preferably PV Fast Blue, commercially available from BASF, cyan, magenta, yellow, red, brown, blue or mixtures thereof, reference for example U.S. Pat. No. 4,883,736, the disclosure of which is totally incorporated herein by reference. Generally, the aforementioned pigment is present in an effective amount of from, for example, about 1 to about 15 percent by weight, and preferably from about 1 to about 3 percent by weight.

For the black developers comprised of toner with a pigment such as carbon black, which developers can be comprised of similar components as the aforementioned colored developers, with the exceptions that a black instead of colored pigment is selected, and the charge enhancing additive is other than an aluminum complex such as an alkyl pyridinium chloride, and preferably cetyl pyridinium chloride, which is present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganoes Anchor Steel Grit, with an average diameter of from about 25 to about 215 microns, and preferably from about 50 to about 150 microns, with a coating of chlorotrifluoroethylene-vinyl chloride copolymer, commercially available as OXY 461 from Occidental Petroleum Company, which coating contains from 0 to about 40 percent by weight of conductive particles homogeneously dispersed in the coating at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as Tedlar ® from E.I. Du Pont de Nemours and Company, present in a coating weight of from about 0.01 to about 0.2, and preferably about 0.05, percent by weight of the carrier. The polyvinyl fluoride coating is generally coated onto the core by a powder coating process wherein the carrier core is coated with the polyvinyl fluoride in powder form and subsequently heated to fuse the coating. In one preferred embodiment, the carrier comprises an unoxidized steel core which is blended with polyvinyl fluoride (Tedlar ®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$ (ohm-cm)$^{-1}$. Optionally, an additional coating of polyvinylidene fluoride, commercially available as Kynar ® from Pennwalt Corporation, may be powder coated on top of the first coating of the carrier in the black developer at a coating weight of from about 0.01 to about 0.2 percent by weight. The carrier for the black developer generally has a conductivity of from about $10^{-14}$ to about $10^{-7}$, and preferably from about $10^{-12}$ to about $10^{-9}$ (ohm-cm)$^{-1}$. Other carriers may be selected including those of the aforementioned copending applications, and/or with conductivities outside the ranges mentioned in an embodiment of the present invention.

Examples of toner resins for the black toner include polyesters, styrene-butadiene polymers, styrene acrylate polymers, and styrene-methacrylate polymers, and particularly styrene-n-butylmethacrylate copolymers wherein the styrene portion is present in an effective amount of, for example, from about 50 to about 65 percent by weight, preferably about 65 percent by weight, and the n-butylmethacrylate portion is present in an amount of from about 20 to about 50 percent by weight, preferably about 42 percent by weight. Generally, the resin is present in an amount of from about 80 to about 98.8 percent by weight, and preferably in an amount of 92 percent by weight. Suitable pigments include those such as carbon black, including Regal ® 330, commercially available from Cabot Corporation, nigrosine, and the like, reference for example U.S. Pat. No. 4,883,376, the disclosure of which is totally incorporated herein by reference. Generally, the pigment is present in an amount of from about 1 to about 15 percent by weight, and preferably in an amount of about 6 percent by weight.

Suitable aluminum complex charge control additives for the colored excluding black toners are illustrated in U.S. Pat. No. 4,845,003, the disclosure of which is totally incorporated herein by reference. These additives are described as being the aluminum compound of an aromatic hydroxycarboxylic acid which is unsubstituted or substituted with alkyl and/or aralkyl, and according to the aforementioned patent are prepared from an aromatic hydroxycarboxylic acid with an alkyl and/or aralkyl by treating the acid with an aluminum imparting agent by a known method. A preferred charge additive is available from Orient Chemical as Bontron E88. This charge additive is generally present in an effective amount of, for example, from about 0.1 to about 10, and preferably from about 0.5 to about 3 percent by weight, although other amounts may be present. The aforementioned toner possesses a negative triboelectric charge as determined by the known Faraday Cage method, which charge is, for example, from about −10 to about −40 microcoulombs per gram and preferably from about −5 to about −25 microcoulombs per gram, and an admix time of from about 15 to about 60 seconds and preferably from about 15 to about 30 seconds as determined in the known charge spectrograph. With respect to the toner containing a black pigment such as carbon black, magnetite or mixtures thereof, there are selected as the charge enhancing additive alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference, distearyl dimethyl ammonium methyl sulfate (DDAMS), reference U.S. Pat. No. 4,560,635, the disclosure of which is totally incorporated herein by reference, and the like. This toner usually possesses a positive charge of from about 10 to about 45 microcoulombs per gram and preferably from about 5 to about 25 microcoulombs per gram, which charge is dependent on a number of known factors as is the situation with the color developer including the amount of charge enhancing additive present and the exact composition of the other compositions such as the toner resin, the pigment, the carrier core, and the coating selected for the carrier core, and an admix time of from about 15 to about 60 seconds and preferably from about 15 to about 30 seconds. These additives are present in various effective amounts of, for example, from about 0.1 to about 20 weight percent and preferably from about 1 to about 10 weight percent. In the preparation of the colored and toner compositions, normally the products obtained comprised of toner resin, pigment and charge enhancing additive can be subjected to micronization and classification, which classification is primarily for the purpose of removing undesirable lines and substantially very large particles to enable, for example, toner particles with an average volume diameter of from about 5 to about 25 microns and preferably from about 10 to about 20 microns.

In addition, external additives of colloidal silica, such as Aerosil® R972, Aerosil® R976, Aerosil® R812, and the like, available from Degussa, and metal salts or metal salts of fatty acids, such as zinc stearate, magnesium stearate, aluminum stearate, cadmium stearate, and the like, may be blended on the surface of the colored toners. Toners with these additives blended on the surface are disclosed in the prior art such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably about 0.3 percent by weight of the toner, and the stearate is present in an amount of from about 0.1 to about 2 percent by weight, and preferably about 0.3 percent by weight, of the toner. Varying the amounts of these two external additives enables adjustment of the charge levels and conductivities of the toners. For example, increasing the amount of silica generally adjusts the triboelectric charge in a negative direction and improves admix times, which are a measure of the amount of time required for fresh toner to become triboelectrically charged after coming into contact with the carrier. In addition, increasing the amount of stearate improves admix times, renders the developer composition more conductive, adjusts the triboelectric charge in a positive direction, and improves humidity insensitivity.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer. The ratio of toner to carrier may vary, however, provided that many of the objectives of the present invention are achieved. For example, an imaging apparatus employed for the process of the present invention may be replenished with a colored developer comprising about 55 percent by weight of toner and about 45 percent by weight of carrier. The triboelectric charge of the colored toners generally is from about −10 to about −30, and preferably from about −15 to about −20 microcoulombs per gram, although the value may be outside of this range. Particle size of the colored toners is generally from about 7 to about 20 microns in volume average diameter, and preferably about 13 microns in volume average diameter, although the value may be outside of this range.

The black toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as Unilin TM. The linear polymeric alcohol is generally present in an amount of from about 0.1 to about 1 percent by weight of the toner.

Black developer compositions for the present invention comprise in an embodiment from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight toner and about 35 percent by weight carrier. The triboelectric charge of the black toners generally is from about +10 to about +30, and preferably from about +13 to about +18 microcoulombs per gram, although the value may be outside of this range. Particle size of the black toners is generally from about 8 to about 13 microns in volume average diameter, and preferably about 11 microns in volume average diameter, although the value may be outside of this range, provided that the objectives of the present invention are achieved.

Coating of the carrier particles of the present invention may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight is achieved.

The toners of the present invention may be prepared by processes such as extrusion, which is a continuous process that entails dry blending the resin, pigment, and charge control additive, placing them into an extruder, melting and mixing the mixture, extruding the material, and reducing the extruded material to pellet form. The pellets are further reduced in size by grinding or jetting, and are then classified by particle size. In an embodiment of the present invention, toner compositions with an average particle size of from about 10 to about 25, and preferably from 10 to about 15 microns are preferred. External additives such as linear polymeric alcohols, silica, or zinc stearate are then blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Other known toner preparation processes can be selected including melt mixing of the components in, for example, a Banbury, followed by cooling, attrition and classification.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A black developer composition was prepared as follows. Ninety-two (92) parts by weight of a styrene-n-butylmethacrylate resin, 6 parts by weight of Regal 330® carbon black obtained from Cabot Corporation, and 2 parts by weight of the charge additive cetyl pyridinum chloride were melt blended in an extruder wherein the die was maintained at a temperature of between 130° and 145° C. and the barrel temperature ranged from about 80° to about 100° C., followed by micronization and air classification to yield toner particles of a size of 12 microns in volume average diameter. Subsequently, carrier particles were prepared by solution coating a Hoeganoes Anchor Steel core with a particle diameter range of from about 75 to about 150 microns, available from Hoeganoes Company, with 0.4 parts by weight of a coating comprising 20 parts by weight of Vulcan carbon black, available from Cabot Corporation, homogeneously dispersed in 80 parts by weight of a chlorotrifluoroethylene-vinyl chloride copolymer, commercially available as OXY 461 from Occidental Petroleum Company, which coating was solution coated from a methyl ethyl ketone solvent. The black developer was then prepared by blending 97.5 parts by weight of the coated carrier particles with 2.5 parts by weight of the toner in a Lodige Blender for about 10 minutes resulting in a developer with a toner exhibiting a triboelectric charge of +18 microcoulombs per gram as determined in the known Faraday Cage apparatus and a carrier conductivity of $6.6\times10^{-10}$ (ohm-cm)$^{-1}$. Admix time for substantially uncharged added toner comprised of the same components of the above prepared toner was less than 30 seconds as determined in the known spectrograph.

EXAMPLE II

A blue developer composition was prepared as follows. Ninety (90) percent by weight of styrene butadiene (89/11), 3 percent of the aluminum complex charge enhancing additive, Bontron E88, obtained from Orient Chemical Company, and 7 percent of the pigment, PV Fast Blue, were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 percent by weight of Aerosil® R972 and 0.3 percent by weight of zinc stearate onto the surface of the toner in a Lodige blender. Subsequently, carrier particles were prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The resulting blue developer was then prepared by blending 97.5 parts by weight of the coated carrier particles with 2.5 parts by weight of the blue toner in a Lodige Blender for about 10 minutes resulting in a developer with a toner exhibiting a triboelectric charge of −19.7 microcoulombs per gram as determined in the known Faraday Cage apparatus and a carrier conductivity of $1.5\times10^{-10}$ (ohm-cm)$^{-1}$. Admix time for substantially uncharged added toner comprised of the same components of the above prepared toner was less than 30 seconds as determined in the known spectrograph.

The above blue developer, 50 weight percent, and the black developer, 50 weight percent, were then incorporated into an imaging device equipped to generate and develop trilevel images according to the method of U.S. Pat. No. 4,078,929, the disclosure of which is totally incorporated herein by reference. A trilevel latent image was formed on the imaging member and the low areas of −100 volts potential were developed with the blue developer, followed by development of the high areas of −750 volts potential with the black developer, subsequent transfer of the two-color image to paper, and heat fusing of the image to the paper. Images formed exhibited excellent copy quality with substantially no background for 400,000 imaging cycles. Also, the aforementioned toners exhibited stable triboelectric charging characteristics, that is the triboelectric charging properties remain relatively constant for 400,000 imaging cycles at relative humidities of from 20 to about 80 percent and at temperatures of from about 25° C. to about 70° C. at which time the test was terminated.

Other colored and black toner and developers were prepared by repeating the procedures of Examples I and II with substantially similar results when these toners were selected for the generation and developer of trilevel images according to the method of U.S. Pat. No. 4,078,829, the disclosure of which has been totally incorporated herein by reference. Thus, for example, a cyan toner was prepared by melt mixing in a Banbury 91.5 weight percent of a styrene butadiene copolymer, 91 percent by weight of styrene and 9 percent by weight of butadiene; 5 percent by weight of Neopen Blue available from BASF Corporation, and 3.5 percent by weight of the charge enhancing additive Bontron E-88. A developer was then prepared by repeating the process of Example II with the same carrier, and there resulted on the toner a charge of −55 microcoulombs per gram, and the admix time for uncharged added toner comprised of the above components was 45 seconds. The yellow developer was prepared by repeating the aforementioned procedure with the exception that there was selected 5 weight of Novaperm Yellow FGL available from American Hoechst and subsequent to preparation of the developer the toner had a triboelectric charge of −37 microcoulombs per gram and the admix time for uncharged toner was 2 minutes as determined in a charge spectrograph. Further, a blue toner was formulated by repeating the aforementioned procedure with the exception that 90 percent by weight of a Pliotone resin, a styrene butadiene resin available from Goodyear Chemical Company, 7 weight percent of PV Fast Blue, and 3 percent by weight of the Bontron E-88 were selected, and on the surface thereof there was blended 0.3 weight percent of Aerosil R972® and 0.3 weight percent of zinc stearate, which blending was accomplished by mixing the surface component with a prepared toner. A developer was prepared by repeating the procedure of Example II and this developer was selected for the trilevel imaging method as disclosed in U.S. Pat. No. 4,078,929 and substantially similar results were obtained.

Various effective amounts of first developer and second developer can be selected for the process of the present invention including, for example, from about 10 to about 90 percent of the first developer and from about 90 to about 10 percent of the second developer, and preferably in an embodiment of the present invention from about 40 to 60 percent of the first colored developer and 60 to 40 percent by weight of the second black developer. Other amounts not specifically mentioned herein can be selected depending, for example, on a number of factors including the specific components selected for the toner and developer and the like.

EXAMPLE III

The process of Example II was repeated with the exception that the coating on the carrier for the blue developer was polyvinylidene fluoride, commercially available as Kynar®, present in a coating weight of 0.17 percent by weight. The blue and black developers were then placed into an imaging device equipped to generate and develop trilevel images according to the method of U.S. Pat. No. 4,078,929. A trilevel latent image was formed on the imaging member and the low areas of −100 volts potential were developed with the blue developer, followed by development of the high areas of −750 volts potential with the black developer, subsequent transfer of the two-color image to paper, and heat fusing of the image to the paper. The optical density of the blue areas was light. It is believed that the carrier in the black developer, which carrier was coated with polyvinylidene fluoride in this experiment, contacted the previously formed blue image on the photoreceptor, charged against the blue toner, and removed blue toner from the blue image, thereby effecting image quality. After several imaging cycles in this experiment, the blue toner that had been carried into the black developer housing by the polyvinylidene fluoride coated carrier impaired the triboelectric characteristics of the black toner and resulted in black areas of the image being developed with blue toner.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging process which comprises (1) charging an imaging member in an imaging apparatus; (2) creating on the member a latent image comprising areas of high, intermediate, and low potential; (3) developing the low areas of potential with a first developer comprising carrier and a first toner comprised of resin, pigment excluding black and an aluminum complex charge enhancing additive of an aromatic hydroxycarboxylic acid, which is unsubstituted or substituted with alkyl and/or arakyl, prepared by the reaction of an aromatic hydroxycarboxylic acid, which is unsubstituted or substituted with alkyl and/or arakyl, with an aluminum salt; (4) developing the high areas of potential with a second developer comprising carrier and a second toner comprised of resin, pigment, and a charge enhancing additive that enables a positively charged toner; (5) transferring the resulting developed image to a substrate; and (6) fixing the image thereto and wherein the first toner has a negative triboelectric charge.

2. A process in accordance with claim 1 wherein the pigment for the first toner is a blue pigment.

3. A process in accordance with claim 1 wherein the pigment for the first toner is PV Fast Blue.

4. A process in accordance with claim 1 wherein the pigment for the second toner is carbon black.

5. A process in accordance with claim 1 wherein the resin is selected from the group consisting of styrene acrylates, styrene methacrylates, styrene butadienes, polyesters, and mixtures thereof.

6. A process in accordance with claim 1 wherein the complex charge enhancing additive is an aluminum compound of a ditertiary butyl salicylic acid or a hydroxynaphthoic acid.

7. A process in accordance with claim 1 wherein the aluminum complex charge enhancing additive is present in an amount of form about 0.1 to about 10 weight percent.

8. A process in accordance with claim 1 wherein the aluminum complex charge enhancing additive is present in an amount of from about 1 to about 3 weight percent.

9. A process in accordance with claim 1 wherein a two-color image is obtained.

10. A process in accordance with claim 1 wherein the first developer comprises a toner with a surface additive.

11. A process in accordance with claim 10 wherein the surface additive is selected from the group consisting of metal salts, metal salts of fatty acids, colloidal silicas, and mixtures thereof.

12. A process in accordance with claim 10 wherein the surface additive is zinc stearate.

13. A process in accordance with claim 10 wherein the surface additive is a colloidal silica comprised of an Aerosil.

14. A process in accordance with claim 10 wherein the surface additive is present in an amount of from about 0.1 to about 3 weight percent.

15. A process in accordance with claim 1 wherein the carrier for each developer contains a polymeric coating thereover.

16. A process in accordance with claim 1 wherein the carrier for each developer contains a polymeric coating with conductive components therein.

17. A process in accordance with claim 1 wherein the carrier is comprised of a core of steel, ferrite, magnetite, or iron.

18. A process in accordance with claim 17 wherein the carrier contains a polymeric coating thereover.

19. A process in accordance with claim 1 wherein the toner for the first developer possesses a triboelectic charge of from about −5 to about −25 microcoulombs per gram.

20. A process in accordance with claim 1 wherein the toner for the second developer possesses a triboelectic charge of from about +5 to about +25 microcoulombs per gram.

21. A process in accordance with claim 1 wherein the low and high areas of potential are developed by a conductive magnetic brush development system.

22. A process in accordance with claim 1 wherein the toner for the first developer is comprised of a first resin present in an amount of from about 80 to about 98 percent by weight and selected from the group consisting of polyesters, styrene-butadiene polymers, styrene-acrylate polymers, styrene-methacrylate polymers, and mixtures thereof; a first blue pigment present in an amount of from about 1 to about 15 percent by weight; an aluminum complex charge additive of an aromatic hydroxycarboxylic salycylic acid, which is unsubstituted or substituted with alkyl and/or aralkyl, and prepared by the reaction of an aromatic hydroxycarboxylic acid, which is unsubstituted or substituted with alkyl and/or arakyl, with an aluminum salt, which additive is present in an amount of from about 0.2 to about 5 percent by weight; colloidal silica surface external additives present in an amount of from about 0.1 to about 2 percent by weight; external additives comprising metal salts or metal salts of fatty acids present in an amount of from about 0.1 to about 2 percent by weight; a first carrier comprising a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0.1 to about 40 percent by weight of the coating of conductive particles and wherein the coating weight is from about 0.1 to about 3 percent by weight of the carrier, and wherein the high areas of potential are developed by conductive magnetic brush development with a developer comprising a black second toner comprising a second resin present in an amount of from about 80 to about 98 percent by weight and selected from the group consisting of polyesters, styrene-butadiene polymers, styrene-acrylate polymers, styrene-methacrylate polymers, and mixtures thereof; a second black pigment, present in an amount of from about 1 to about 15 percent by weight; and as a charge enhancing additive an alkyl pyridinium halide, an organic sulfate or sulfonate, or distearyl dimethyl ammonium methyl sulfate present in an amount of from about 0.1 to about 6 weight percent; and a second carrier comprising a steel core with an average diameter of from about 25 to about 215 microns and a coating selected from the group consisting of chlorotrifluoroethylene-vinyl chloride copolymer containing from 0.1 to about 40 percent by weight of conductive particles at a coating weight of from about 0.4 to about 1.5 percent by weight of the carrier; polyvinyl fluoride at a coating weight of from about 0.01 to about 0.2 percent by weight of the carrier; and polyvinyl chloride at a coating weight of from about 0.01 to about 0.2 percent by weight of the carrier.

23. A process in accordance with claim 1 wherein the imaging member is comprised of a layered organic photoreceptor.

24. A process in accordance with claim 1 wherein the high level of potential is from about −750 to about −850 volts, the intermediate level of potential is from about −350 to about −450 volts, and the low level of potential is from about −100 to about −180 volts.

25. A process in accordance with claim 1 wherein the levels of potential are separated by from about 100 to about 350 volts.

26. A process in accordance with claim 22 wherein the first carrier has a conductivity of from about $10^{-14}$ to about $10^{-7}$ (ohm-cm)$^{-1}$.

27. A process in accordance with claim 22 wherein the second carrier has a conductivity of from about $10^{-14}$ to about $10^{-7}$ (ohm-cm)$^{-1}$.

28. A process in accordance with claim 1 wherein the colored developer is contained in a housing biased to from about −450 to about −550 volts.

29. A process in accordance with claim 1 wherein the black developer is contained in a housing biased to from about −250 to about −350 volts.

30. A process in accordance with claim 1 wherein the toner particles on the developed image are charged to a single polarity prior to transfer.

31. A process in accordance with claim 1 wherein the transferred image is permanently affixed to the substrate by the application of heat and pressure.

32. A process in accordance with claim 1 wherein the first carrier has an average diameter of from about 50 to about 150 microns.

33. A process in accordance with claim 1 wherein the first carrier core comprises unoxidized steel.

34. A process in accordance with claim 1 wherein the first carrier contains a coating obtained by a solution coating process.

35. A process in accordance with claim 1 wherein the first carrier comprises a coating of methyl terpolymer containing from 0.1 to about 40 percent by weight of carbon black at a coating weight of from about 0.4 to about 1.5 percent by weight of the carrier.

36. A process in accordance with claim 1 wherein the first carrier comprises a coating of a mixture of polymethyl methacrylate present in an amount of from about 80 to about 90 percent by weight, and carbon black present in an amount of from about 10 to about 20 percent by weight at a coating weight of about 1 percent by weight of the carrier.

37. A process in accordance with claim 1 wherein the first carrier comprises a coating which comprises from about 20 to about 30 percent by weight of carbon black and from about 70 to about 80 percent by weight of a blend comprising from about 35 to about 65 percent by weight of polymethyl methacrylate and from about 35 to about 65 percent by weight of chlorotrifluoroethylene-vinyl chloride copolymer at a coating weight of about 1 percent by weight.

38. A process in accordance with claim 1 wherein the colored first toner comprises a styrene-butadiene copolymer wherein the styrene portion is present in an amount of from about 83 to about 93 percent by weight and the butadiene segment is present in an amount of from about 7 to about 17 percent by weight.

39. A process in accordance with claim 1 wherein the colored first toner comprises a styrene-n-butylmethacrylate copolymer wherein the styrene portion is present in an amount of from about 50 to about 70 percent by weight and the n-butylmethacrylate segment is present in an amount of from about 30 to about 50 percent by weight.

40. A process in accordance with claim 1 wherein the colored first toner comprises a mixture of a styrene-butadiene copolymer wherein the styrene segment is present in an amount of from about 83 to about 93 percent by weight and the butadiene portion is present in an amount of from about 7 to about 17 percent by weight, and a styrene-n-butylmethacrylate copolymer wherein the styrene segment is present in an amount of from about 50 to about 70 percent by weight and the n-butylmethacrylate portion is present in an amount of from about 30 to about 50 percent by weight.

41. A process in accordance with claim 1 wherein the colored first toner comprises a styrene-n-butylmethacrylate polymer wherein the styrene portion is present in an amount of about 65 percent by weight, and the n-butylmethacrylate portion is present in an amount of about 35 percent by weight.

42. A process in accordance with claim 2 wherein the triboelectric charge on the colored first toner is from about −5 to about −25 microcoulombs per gram.

43. A process in accordance with claim 2 wherein the colored first toner has an average particle diameter of from about 11 to about 15 microns.

44. A process in accordance with claim 1 wherein the carrier for the second developer contains a coating comprising from about 60 to 100 percent of chlorotrifluoroethylene-vinyl chloride copolymer and from 0 to about 40 percent by weight of carbon black at a coating weight of from about 0.4 to about 1.5 percent by weight of the carrier.

45. A process in accordance with claim 44 wherein the second carrier is coated by a solution coating process.

46. A process in accordance with claim 1 wherein the carrier for the second developer contains a coating of polyvinyl fluoride at a coating weight of about 0.05 percent by weight of the carrier.

47. A process in accordance with claim 46 wherein the second carrier is coated by a powder coating process.

48. A process in accordance with claim 1 wherein the second carrier possesses a second coating on top of the first coating comprising polyvinylidene fluoride at a coating weight of from about 0.01 to about 0.2 percent by weight of the carrier.

49. A process in accordance with claim 1 wherein the carrier for the second developer comprises an unoxidezed steel core coated with polyvinylfluoride at a coating weight of about 0.05 percent by weight of the core wherein the carrier has a conductivity of about $7.6\times10^{-10}$ (ohm-cm)$^{-1}$.

50. A process in accordance with claim 1 wherein the first colored toner contains external additives comprising metal salts or metal salts of fatty acids present in an amount of from about 0.1 to about 2 percent by weight of the toner.

51. A process in accordance with claim 1 wherein the first colored toner contains colloidal silica present in an amount of from about 0.1 to about 2 percent by weight of the toner, and wherein the silica is present on the surface of the toner.

52. A process in accordance with claim 1 wherein the first colored toner contains a colloidal silica surface external additive in an amount of from about 0.1 to about 2 percent by weight of the toner, and external additives comprising metal salts or metal salts of fatty acids present in an amount of from about 0.1 to about 2 percent by weight of the toner.

53. A process in accordance with claim 1 wherein the black second toner comprises from about 70 to about 85 percent by weight of the second resin, from about 5 to about 10 percent by weight of carbon black, and from about 0.2 to about 3 percent by weight of charge enahncing additive.

54. A process in accordance with claim 1 wherein the charge enhancing additive is an alkyl pyridinium halide.

55. A process in accordance with claim 54 wherein the charge enhancing additive is cetyl pyridinium chloride.

56. A process in accordance with claim 1 wherein the black second toner has an average particle diameter of from about 10 to about 15 microns.

57. A process for obtaining two-color images which comprises:

(1) charging an imaging member;

(2) creating on the member a latent image comprising areas of high, medium, and low potential;

(3) developing the low areas of potential with a colored developer which comprises:

(a) a colored first toner comprising (i) a first resin present in an amount of from about 80 to about 98 percent by weight and selected from the group consisting of styrene-butadiene copolymers wherein the styrene portion is present in an amount of from about 83 to about 93 percent by weight and the butadiene portion is present in an amount of from about 7 to about 17 percent by weight, styrene-n-butylmethacrylate copolymers wherein the styrene portion is present in an amount of from about 50 to about 70 percent by weight and the n-butylmethacrylate portion is present in an amount of from about 30 to about 50 percent by weight, and mixtures thereof;

(ii) a first blue pigment present in an amount of from about 1 to about 15 percent by weight;

(iii) an aluminum complex charge enhancing additive of an aromatic hydroxcarboxylic acid, which is unsubstituted or substituted with alkyl and/or aralkyl, and prepared by the reaction of an aromatic hydroxycarboxylic acid, which is unsubstituted or substituted, with an aluminum salt, which additive is present in an amount of from about 0.1 about 5 percent by weight;

(iv) colloidal silica present in an amount of from about 0.1 to about 2 percent by weight of the toner, wherein the silica is present on the surface of the toner; and (v) zinc stearate present in an amount of from about 0.1 to about 2 percent by weight of the toner, wherein the zinc stearate is present on the surface of the toner; and (b) a first carrier comprising:

(i) a steel core with an average diameter of from about 25 to about 215 microns; and (ii) a coating selected from the group consisting of methyl terpolymer containing from 0.1 to about 40 percent by weight of carbon black at a coating weight of from about 0.2 to about 3 percent by weight of the carrier; a mixture of polymethylmethacrylate present in an amount of from about 80 to about 90 percent by weight, and carbon black present in an amount of from about 10 to about 20 percent by weight at a coating weight of from about 0.2 to about 3 percent by weight of the carrier; and a mixture of carbon black present in an amount of from about 20 to about 30 percent by weight, and a blend of from about 35 to about 65 percent by weight of polymethylmethacrylate and from about 35 to about 65 percent by weight of chlorotrifluoroethylene-vinyl chloride copolymer at a coating weight of from about 0.2 to about 3 percent by weight of the carrier;

(4) subsequently developing the high areas of potential with a black developer which comprises:

(a) a black second toner comprising:

(i) a second resin present in an amount of from about 80 to about 98 percent by weight and comprising a styrene-n-butylmethacrylate copolymer wherein the styrene portion is present in an amount of from about 50 to about 70 percent by weight and the n-butylmethacrylate portion is present in an amount of from about 30 to about 50 percent by weight;

(ii) a second black pigment present in an amount of from about 1 to about 15 percent by weight;

(iii) a charge enhancing additive selected from the group consisting of alkyl pyridinium halides, organic sulfates and sulfonates, and distearyl dimethyl ammonium methyl sulfate; and (b) a second carrier comprising:

(i) a steel core with an average diameter of from about 25 to about 215 microns; and (ii) a coating selected from the group consisting of chlorotrifluoroethylene-vinyl chloride copolymer containing from 0.1 to about 40 percent by weight of carbon black at a coating weight of from about 0.4 to about 1.5 percent by weight of the carrier, and polyvinyl fluoride at a coating weight of from about 0.01 to about 0.2 percent by weight of the carrier;

(5) transferring the developed two-color image to a substrate; and (6) permanently affixing the image to the substrate.

58. A process in accordance with claim 57 wherein the first colored toner contains colloidal silica present in an amount of from about 0.1 to about 2 percent by weight of the toner, wherein the silica is present on the surface of the toner.

59. A process in accordance with claim 57 wherein the first colored toner contains zinc stearate present in an amount of from about 0.1 to about 2 percent by weight, wherein the zinc stearate is present on the surface of the toner.

60. A process in accordance with claim 57 wherein the first colored toner contains colloidal silica present in an amount of from about 0.1 to about 2 percent by weight of the toner, wherein the silica is present on the surface of the toner, and zinc stearate present in an amount of from about 0.1 to about 2 percent by weight, wherein the zinc stearate is present on the surface of the toner.

61. A process for forming two-color images which comprises (1) charging an imaging member in an imaging apparatus; (2) creating on the member a latent image comprising areas of high, intermediate, and low potential; (3) developing the low areas of potential with a developer comprising a colored first toner comprising a first resin selected from the group consisting of polyesters, styrene-butadiene polymers, styrene-acrylate polymers, styrene-methacrylate polymers, and mixtures thereof; a first blue pigment; an aluminum complex charge enhancing additive of an aromatic hydroxycarboxylic acid, which is unsubstituted or substituted with alkyl and/or aralkyl, and prepared by the reaction of an aromatic hydroxycarboxylic acid, which is unsubstituted or substituted with alkyl and/or aralkyl, with an aluminum salt; colloidal silica surface external additives, and external surface additives comprising metal salts or metal salts of fatty acids; and a first carrier comprising a core and a coating selected from the group consisting of methyl terpolymer, polymethyl methacrylate, and a blend of from about 35 to about 65 percent by weight of polymethacrylate and from about 35 to about 65 percent by weight of chlorotrifluoroethylene-vinyl chloride copolymer, wherein the coating contains from 0.1 to about 40 percent by weight of the coating of conductive particles; (4) subsequently developing the high areas of potential with a developer comprising a black second toner comprising a second resin present selected from the group consisting of polyesters, styrene-butadiene polymers, styrene-acrylate polymers, styrene-methacrylate polymers, and mixtures thereof; a black pigment; and as a charge enhancing additive an alkyl pyridinium halide; and a second carrier comprising a core and a coating selected from the group consisting of chlorotrifluoroethylene-vinyl chloride copolymer containing from 0.1 to about 40 percent by weight of conductive particles; polyvinyl fluoride; and polyvinyl chloride; (5) transferring the developed two-color image to a substrate; and (6) fixing the image thereto, and in wherein the first toner has a negative triboelectric charge.

62. A process in accordance with claim 61 wherein the low areas of potential and the high areas of potential of the latent image are developed by conductive magnetic brush development.

63. A process in accordance with claim 61 wherein the first carrier comprises a steel core.

64. A process in accordance with claim 61 wherein the second carrier comprises a steel core.

65. A process in accordance with claim 61 wherein the high level of potential is from about −750 to about −850 volts, the intermediate level of potential is from about −350 to about −450 volts, and the low level of potential is from about −100 to about −180 volts.

66. A process in accordance with claim 61 wherein the levels of potential are separated by from about 100 to about 350 volts.

67. A process in accordance with claim 61 wherein the first resin is present in an amount of from about 80 to about 90 percent by weight of the colored first toner and the first pigment is present in an amount of from about 1 to about 15 percent by weight of the colored first toner.

68. A process in accordance with claim 61 wherein the second resin is present in an amount of from about 80 to about 98 percent by weight of the black second toner and the second pigment is present in an amount of from about 1 to about 15 percent by weight of the black second toner.

69. A process in accordance with claim 61 wherein the alkyl pyridinium halide is cetyl pyridinium chloride.

70. A process in accordance with claim 61 wherein the aluminum complex charge enhancing additive is selected from the group consisting of aluminum palmitate, aluminum nicotinate, aluminum benzoate, and Bontron E-88 TM.

71. A process in accordance with claim 1 wherein the aluminum complex charge enhancing additive is selected from the group consisting of aluminum palmitate, aluminum nicotinate, aluminum benzoate, and Bontron E-88 TM.

72. An imaging process which comprises (1) charging an imaging member in an imaging apparatus; (2) creating on the member a latent image comprising areas of high, intermediate, and low potential; (3) developing the low areas of potential with a toner comprised of resin, pigment excluding black and an aluminum complex charge enhancing additive of an aromatic hydroxycarboxylic acid, which is unsubstituted or substituted with alkyl and/or aralkyl, and prepared by the reaction of an aromatic hydroxycarboxylic acid, which is unsubstituted or substituted with alkyl and/or aralkyl, with an aluminum salt; (4) developing the high areas of potential with a toner comprised of resin, pigment, and a charge enhancing additive that enables a positively charged toner; (5) transferring the resulting developed image to a substrate; and (6) fixing the image thereto, and wherein the first toner has a negative triboelectric charge.

73. A process in accordance with claim 1 wherein the aluminum complex charge enhancing additive is of the formula $$[Al(Y)_a]^{b-} \cdot X^{+b}$$

wherein Y is a difunctional or divalent radical, X is a counter ion, a is the number 2 or 3, b is the number 1, when a is 2 and b is 3 when a is the number 3.

74. A process in accordance with the claim 73 wherein X is hydrogen, $NH_4$, an ammonium ion of a primary, secondary or tertiary amine, or a quaternary ammonium ion.

* * * * *